US009789023B1

(12) United States Patent
Lee et al.

(10) Patent No.: US 9,789,023 B1
(45) Date of Patent: Oct. 17, 2017

(54) MULTI-FUNCTION LOWER LIMB AMBULATION REHABILITATION AND WALKING ASSIST DEVICE

(71) Applicant: LUNGHWA UNIVERSITY OF SCIENCE AND TECHNOLOGY, Taoyuan (TW)

(72) Inventors: Lian-Wang Lee, Taoyuan (TW); Hsin-Han Chiang, Taoyuan (TW)

(73) Assignee: Lunghwa University of Science and Technology, Taoyuan (TW)

( * ) Notice: Subject to any disclaimer, the term of this patent is extended or adjusted under 35 U.S.C. 154(b) by 0 days.

(21) Appl. No.: 15/279,720

(22) Filed: Sep. 29, 2016

(51) Int. Cl.
*A63B 24/00* (2006.01)
*A61H 3/00* (2006.01)

(52) U.S. Cl.
CPC ..... *A61H 3/00* (2013.01); *A63B 24/0021* (2013.01); *A63B 24/0062* (2013.01); *A63B 24/0087* (2013.01); *A61H 2201/5061* (2013.01); *A61H 2201/5084* (2013.01); *A63B 2024/0025* (2013.01)

(58) Field of Classification Search
CPC . A63B 24/00; A63B 24/0087; A63B 24/0062; A63B 24/0021; A63B 2201/5061; A63B 2201/5084; A63B 2024/0025; A61H 3/00
See application file for complete search history.

(56) References Cited

U.S. PATENT DOCUMENTS

| | | | | |
|---|---|---|---|---|
| 8,684,890 | B2 * | 4/2014 | Bosecker | A61H 1/005 482/54 |
| 9,498,401 | B2 * | 11/2016 | Herr | A61H 1/0255 |
| 9,649,243 | B2 * | 5/2017 | Johnson | A61H 3/04 |
| 2004/0143198 | A1 * | 7/2004 | West | A61F 5/0102 601/5 |
| 2012/0108392 | A1 * | 5/2012 | Chu | A63B 22/0292 482/4 |
| 2014/0100491 | A1 * | 4/2014 | Hu | A61H 3/008 601/27 |
| 2015/0297439 | A1 * | 10/2015 | Karlovich | A63B 22/02 280/650 |
| 2015/0297934 | A1 * | 10/2015 | Agrawal | A61H 1/0266 482/4 |
| 2016/0166460 | A1 * | 6/2016 | Murphy | A63B 69/0064 601/34 |

* cited by examiner

*Primary Examiner* — Glenn Richman
(74) *Attorney, Agent, or Firm* — Rosenberg, Klein & Lee

(57) ABSTRACT

A multi-function lower limb ambulation rehabilitation and walking assist device is provided. Through a suspension unit to support the user, the tolerance of the user's leg is reduced. For users of different weights, it can be used for a walking rehabilitation training of the lower limbs to achieve the best training effect. An exoskeleton rehabilitation device has a hip joint linear actuator, a knee joint linear actuator, a first actuator, a second actuator, a third actuator, and a fourth actuator to drive the one-legged the exoskeleton rehabilitation device which is safe, comfortable, reliable, practical and convenient. An indoor and outdoor navigation auxiliary device can be used as a blind guiding device. Through a display unit, a navigation and positioning system displays the orientation of the user in a virtual map corresponding to the real operation environment and a desired location point.

8 Claims, 5 Drawing Sheets

MULTI-FUNCTION LOWER LIMB AMBULATION REHABILITATION AND WALKING ASSIST DEVICE

FIELD OF THE INVENTION

The present invention relates to a multi-function lower limb ambulation rehabilitation and walking assist device, and more particularly to an exoskeleton rehabilitation device for lower limbs. Besides, through an indoor and outdoor navigation auxiliary device, the user can move to a desired place.

BACKGROUND OF THE INVENTION

In the wake of technological progress and rise in the standard of living, many countries are facing an aging society. Health issues are also gaining increased attention along with aging. Among the aged population are many patients with nervous system disorders and cerebrovascular diseases, e.g. stroke, spinal injury, cerebral palsy or brain damage, multiple sclerosis, and central nervous system damage caused by Parkinson's disease. These patients have various degrees of motor dysfunction, even full paralysis or hemiplegic paralysis in severe cases. Furthermore, there are increasingly more cases of injuries to the nervous system or upper/lower limbs due to traffic accidents. Since walking ability is the key indicator of mobility, and the prerequisite for living normally and independently, the day-to-day living of most post-traffic accident patients is affected, bringing certain burden and challenges to the family.

While the majority of patients suffering from central nervous system damage recover their ability to walk independently after surgery or drug treatment, most of them will be affected by some after-effects, e.g. decrease in motor control, joint stiffness and abnormal gait which cause decreased balance, leading to severe impact on mobility, awareness of the surrounding environment and quality of living. Principles and clinical studies of rehabilitation medicine have shown that, besides early surgery and drug treatment, the correct application of rehabilitation training is crucial to the recovery and improvement of motor functions. The earlier patients start rehabilitation training after the acute phase, the better will the result of recovery be. In particular, the basis of the principles of rehabilitation treatment is the flexibility of the brain. Related medical studies have shown that while damaged nerve cells cannot be regenerated, the nerve tissue could recover its lost function by reorganization or compensation of functions, indicating that the brain is flexible. Both animal and human experiments have shown that proper gait training by actively or passively performing specific functions of the limbs repeatedly can stimulate the proprioceptors to make changes to the map in the central nervous system, encouraging flexibility of the brain and spine to relearn one's gait. Currently, rehabilitation treatment is mostly done manually. It requires tremendous time and energy from rehabilitation therapists, severely limiting the efficiency and effectiveness of rehabilitation training. Moreover, rehabilitation equipment used is simple and do not meet patients' requirement for progressive and focused rehabilitation.

With development in intelligent robotics and expansion of the rehabilitation treatment market, the combination of rehabilitation training and robotics will effectively solve problems that occur in traditional rehabilitation training. As the designing of a safe, quantitative, effective and repeatable multipurpose rehabilitation training system has become an urgent problem for modern rehabilitation medicine and treatment, rehabilitation robots have been developed in response to the problem. Rehabilitation robot is an important branch of medical robots, integrating rehabilitation medicine, biomechanics, mechanics, material mechanics, mechanism, electronics, computer science and robotics. Unlike industrial robots, the rehabilitation robot is in direct contact with the human body and operates within the same space as the patient, allowing the patient to achieve comprehensive and coordinate exercise using rehabilitative devices. Controlled by computer, the rehabilitation robot is equipped with corresponding sensors and safety system to automatically adjust training parameters according to actual operation of different patients, achieving optimal rehabilitation result. Thus, rehabilitation robots help patients relearn skills, and increases rehabilitation motivation and result. Not only does it help patients achieve their maximum functional capacity, it also relieves rehabilitation therapists' heavy workload in physical training, allowing them greater energy to focus on rehabilitation related research.

The main reason for gait dysfunction in stroke patients is damaged motor cells and motor conduction caused by brain injury, which leads to diminished active control, and changes to muscle tension and reduced muscular functions. Stroke patients will have abnormal gait or unable to walk, and appear to walk slowly, with difficulty and have unstable balance. In terms of rehabilitation training, traditional single-motion training does improve the patients' physical functions and walking ability to some degree. However, it does not emphasize overall walking training at an early stage, and much energy and time is spent helping patients complete the process from in-bed exercise to body weight shifting and balance maintenance. Furthermore, lower-limb weight-bearing training using walking stick, ambulation aid or parallel bar does not correct patients' gait effectively, and will even cause gait abnormality from increased upper limb strength. BWSTT (Body Weight Support Treadmill Training) is currently one of the most effective and commonly used rehabilitation training method for patients with weakened lower limbs and those with hemiplegic paralysis; its results recognized by medical experts locally and overseas. Weight bearing is the basis for walking normally but patients with weakened lower limbs and those with hemiplegic paralysis have reduced ability to bear weight in their lower limbs, causing difficulty in shifting their body weight, and affecting their body balance and quality of their walking. BWSTT can reduce burden on the legs, allowing patients with inadequate lower-limb muscle to achieve gait training safely, promoting the establishment of normal gait pattern which is conducive to restoring walking function. During the training process, the rehabilitation therapist may appropriately increase weight bearing training and gradually reduces weight support according to each patient's walking ability and gait pattern improvement, and ultimately allow patients to walk bearing full weight. Currently, the most common methods of weight support used in rehabilitation are water walking, and using walking stick and crutch. Water walking requires a swimming pool and the general public may not have access to a swimming pool, which poses great inconvenience for patients' rehabilitation. On the other hand, using a walking stick or crutch will shift the body weight to be borne by the lower limb to the shoulder joint, causing fatigue to the shoulder joint from the additional burden, resulting in short training time and increasing the likelihood of gait abnormality. The lack of balancing function on the walking stick or crutch may also cause patients to fall and get hurt. Furthermore, existing walk-assist robots do not provide adequate weight support and are unable to maintain gait balance. Their hardware parts also take up tremendous space, and must be operated within specific space and location.

Accordingly, the inventor of the present invention has devoted himself based on his many years of practical experiences to solve these problems.

SUMMARY OF THE INVENTION

The primary object of the present invention is to solve the problems, namely, rehabilitation equipment is bulky, rehabilitation site is restricted, and the way of weight support for rehabilitation is inconvenience. A conventional walking assist robot has the problem that the assistance in weight support is too small, without a function to balance ambulation. This invention allows a patient to move indoors and outdoors for rehabilitation, mitigates the maladjustment of rehabilitation, and enhances the motivation and result of rehabilitation.

In order to achieve the aforesaid object, a multi-function lower limb ambulation rehabilitation and walking assist device is provided. The multi-function lower limb ambulation rehabilitation and walking assist device comprises an exoskeleton rehabilitation device. The exoskeleton rehabilitation device comprises a hip joint member. The hip joint member is pivotally connected with a thigh frame. The hip joint member is pivotally connected with a first actuator. The thigh frame is pivotally connected with a second actuator. The first actuator and the second actuator are coupled with a hip joint linear actuator. The first actuator and the second actuator are coupled with a processing unit. One end of the thigh frame, opposite the hip joint member, is provided with a knee joint member. The knee joint member is configured to connect the thigh frame and a shank frame. The knee joint member is pivotally connected with a third actuator. The shank frame is pivotally connected with a fourth actuator. The third actuator and the fourth actuator are coupled with a knee joint linear actuator. The third actuator and the fourth actuator are coupled with the processing unit. The processing unit commands the first actuator and the second actuator to drive the hip joint linear actuator respectively and the third actuator and the fourth actuator to drive the knee joint linear actuator respectively. The hip joint member and the thigh frame are pivotally connected with each other through a first non-contact angle sensor to sense the angle between the thigh frame and the ground. The knee joint member and the shank frame are pivotally connected with each other through a second non-contact angle sensor to sense the angle between the shank frame and the ground. The first non-contact angle sensor and the second non-contact angle sensor are coupled with the processing unit, respectively. The first non-contact angle sensor and the second non-contact angle sensor capture the signals of the angular displacement of the hip joint member and the knee joint member in a walk cycle and send the respective signals to the processing unit, enabling the processing unit to control the actuation of the first actuator, the second actuator, the third actuator, and the fourth actuator. The exoskeleton rehabilitation device is connected with a weight support system. The weight support system comprises at least one suspension unit. The suspension unit comprises at least one tension sensing unit to sense a weight. The weight support system is provided with four weight support linear actuators. The weight support linear actuators are coupled with the tension sensing unit respectively to steady the center of gravity of the weight support system and the weight. The suspension unit is provided with a receiving member. The receiving member is provided with a board. The board has a light reflection portion. The bottom of the weight support system is further provided with at least one moving device.

According to the aforesaid multi-function lower limb ambulation rehabilitation and walking assist device, wherein the exoskeleton rehabilitation device is provided with at least one adjustment member. The adjustment member is adapted to tie the leg of a user. The tightness of the adjustment member is adjustable. The thigh frame is provided with a thigh length adjustment mechanism. The shank frame is provided with a shank length adjustment mechanism.

According to the aforesaid multi-function lower limb ambulation rehabilitation and walking assist device, wherein the processing unit is coupled with an indoor and outdoor navigation auxiliary device. The indoor and outdoor navigation auxiliary device is provided with an armrest device. The armrest device is provided with at least one pressure sensor. The pressure sensor is coupled with the processing unit. The indoor and outdoor navigation auxiliary device is further coupled with a navigation and positioning system and a moving unit. The navigation and positioning system and the moving unit are coupled with the processing unit, respectively. The navigation and positioning system is provided with a virtual map corresponding to a real operation environment and orients the exoskeleton rehabilitation device at a position point in the virtual map. By setting a location point through the navigation and positioning system, the processing unit controls the moving unit to move from the position point to the location point displayed in the virtual map of the navigation and positioning system. The indoor and outdoor navigation auxiliary device is further coupled with a front searchlight.

According to the aforesaid multi-function lower limb ambulation rehabilitation and walking assist device, wherein the indoor and outdoor navigation auxiliary device is coupled with a remote monitoring system. The remote monitoring system is used to monitor the position of the indoor and outdoor navigation auxiliary device. The remote monitoring system receives the signals of the angular displacement of the hip joint member and the knee joint member in a walk cycle captured by the first non-contact angle sensor and the second non-contact angle sensor.

According to the aforesaid multi-function lower limb ambulation rehabilitation and walking assist device, wherein the processing unit is further coupled with a video camera and a laser rangefinder. Through the video camera and the laser rangefinder, the processing unit analyzes a motion trajectory of an object to detect a relative location of an obstacle in front and controls the moving unit to move for guiding the exoskeleton rehabilitation device to move away from the obstacle.

According to the aforesaid multi-function lower limb ambulation rehabilitation and walking assist device, wherein the indoor and outdoor navigation auxiliary device is further coupled with a display unit. The display unit is used to display the virtual map, the position point, and the location point. The navigation and positioning system is able to plan a route from the position point to the location point in the virtual map and display the route on the display unit.

According to the aforesaid multi-function lower limb ambulation rehabilitation and walking assist device, wherein the indoor and outdoor navigation auxiliary device is further coupled with an ultrasonic sensing unit. The ultrasonic sensing unit detects a distance value between the exoskeleton rehabilitation device and the indoor and outdoor navigation auxiliary device for the processing unit to control the speed of movement of the moving unit of the indoor and outdoor navigation auxiliary device.

According to the aforesaid multi-function lower limb ambulation rehabilitation and walking assist device, wherein the ultrasonic sensing unit is coupled with a filter. The filter is used to filter noise of the distance value detected by the ultrasonic sensing unit.

The present invention has the following advantages and effects:

1. Through the suspension unit to support the user's weight, the tolerance of the user's leg is reduced to mitigate the burden of the lower limbs to support the weight. For users of different weights, the exoskeleton rehabilitation device can be used for a walking rehabilitation training of the lower limbs to achieve the best training effect and to mitigate the burden of the lower limbs to support the weight.

2. Compared to a conventional ambulation rehabilitation training system, the exoskeleton rehabilitation device of the present invention has the hip joint linear actuator, the knee joint linear actuator, the first actuator, the second actuator, the third actuator, and the fourth actuator to drive the one-legged the exoskeleton rehabilitation device. The exoskeleton rehabilitation device is safe, comfortable, reliable, practical and convenient. The required drive components are fewer, so the structure of the present invention is simple and easy for maintenance. Moreover, the exoskeleton rehabilitation device can be used to train walking, without using a treadmill, so that the user can directly walk on the even ground. Furthermore, the exoskeleton rehabilitation device captures the information of the conditions of each joint and both legs of the user in a walk cycle to control the harmony of the exoskeleton rehabilitation device and the user for the user to attain the best ambulation training and achieve correct walking ambulation and balance control effects.

3. The indoor and outdoor navigation auxiliary device of the present invention can be used as a blind guiding device. Through the menu of the display unit, the navigation and positioning system orients the exoskeleton rehabilitation device at the position point in the virtual map corresponding to the real operation environment and the desired location point, and the navigation and positioning system plans the route from the position point to the location point in the virtual map through the processing unit for the user to clearly understand his/her orientation. The indoor and outdoor navigation auxiliary device uses the ultrasonic sensing unit, the video camera, the laser rangefinder, and the infrared sensor to calculate the advance speed and the turning speed and to dodge the obstacle in front. Furthermore, the indoor and outdoor navigation auxiliary device transmits the information of the speed, the coordinates, and the position in the map during walking to the remote monitoring system through a wireless area network so as to monitor the position of the user remotely. The receiving member is provided with the board having a light reflection portion, which enhances the safety for the user to walk at night. Furthermore, the user can turn on the front searchlight for viewing the front condition.

4. When in use, the user can hold on the armrest device. Compared to the conventional pressure sensor, the pressure sensor of the present invention can get the walking information relating to the pressure and pressure distribution. When the user applies a force to the pressure sensor, the walking information relating to the pressure and pressure distribution is transmitted to the processing unit. The processing unit analyzes the walking information and then commands the moving unit to make a turn.

DESCRIPTION OF THE PREFERRED EMBODIMENTS

Embodiments of the present invention will now be described, by way of example only, with reference to the accompanying drawings.

Figure 1:
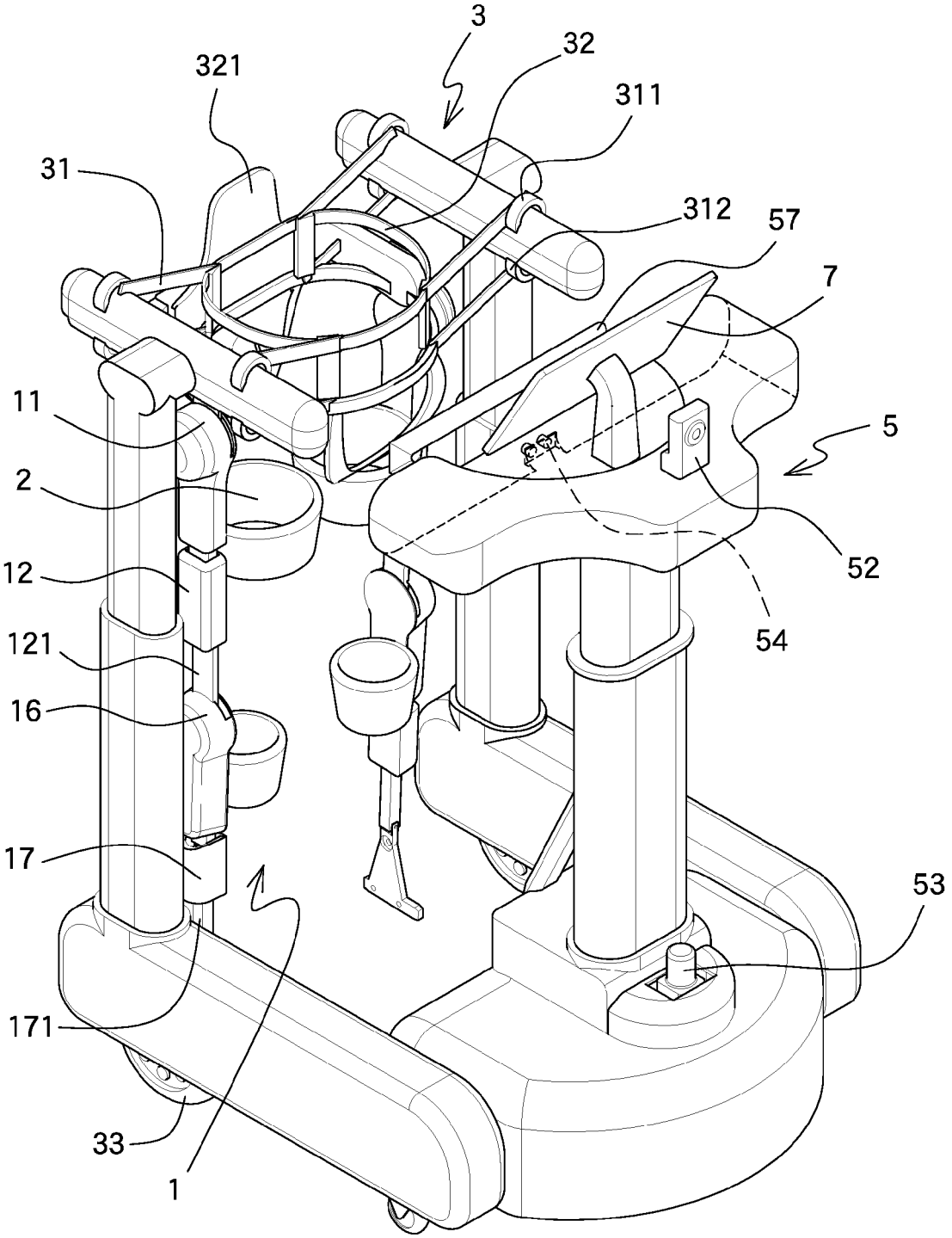
FIG. 1 is a perspective view of the present invention.

Referring to FIG. 1, the present invention relates to a multi-function lower limb ambulation rehabilitation and walking assist device, and comprises an exoskeleton rehabilitation device 1. The exoskeleton rehabilitation device 1 comprises a hip joint member 11. The hip joint member 11 is pivotally connected with a thigh frame 12. The thigh frame 12 is provided with a thigh length adjustment mechanism 121. The hip joint member 11 is pivotally connected with a first actuator 13*a*. The thigh frame 12 is pivotally connected with a second actuator 13*b*. The first actuator 13*a* and the second actuator 13*b* are coupled with a hip joint linear actuator 14*a*. The first actuator 13*a* and the second actuator 13*b* are coupled with a processing unit 141. The hip joint member 11 and the thigh frame 12 are pivotally connected with each other through a first non-contact angle sensor 15*a* to sense the angle between the thigh frame 12 and the ground. One end of the thigh frame 12, opposite the hip joint member 11, is provided with a knee joint member 16. The knee joint member 16 is configured to connect the thigh frame 12 and a shank frame 17. The shank frame 17 is provided with a shank length adjustment mechanism 171. The knee joint member 16 is pivotally connected with a third actuator 13*c*. The shank frame 17 is pivotally connected with a fourth actuator 13*d*. The third actuator 13*c* and the fourth actuator 13*d* are coupled with a knee joint linear actuator 14*b*. The third actuator 13*c* and the fourth actuator 13*d* are coupled with the processing unit 141.

The knee joint member 16 and the shank frame 17 are pivotally connected with each other through a second non-contact angle sensor 15*b* to sense the angle between the shank frame 17 and the ground. The processing unit 141 commands the first actuator 13*a* and the second actuator 13*b* to drive the hip joint linear actuator 14*a*, respectively. The processing unit 141 commands the third actuator 13*c* and the fourth actuator 13*d* to drive the knee joint linear actuator 14*b*, respectively. The first non-contact angle sensor 15*a* and the second non-contact angle sensor 15*b* are coupled with the processing unit 141, respectively. The first non-contact angle sensor 15*a* and the second non-contact angle sensor 15*b* capture the signals of the angular displacement of the hip joint member 11 and the knee joint member 16 in a walk cycle and send the respective signals to the processing unit 141, such that the processing unit 141 controls the actuation of the first actuator 13*a*, the second actuator 13*b*, the third actuator 13*c*, and the fourth actuator 13*d*.

At least one adjustment member 2 is mounted to the exoskeleton rehabilitation device 1. The adjustment member 2 is adapted to tie the leg of the user 8. The tightness of the adjustment member 2 is adjustable according to the demand of the user 8.

A weight support system 3 is connected to the exoskeleton rehabilitation device 1. The weight support system 3 comprises at least one suspension unit 31. The suspension unit 31 comprises at least one tension sensing unit 311 to sense the use's weight. In an embodiment, the weight support system 3 is provided with four weight support linear actuators 312. The weight support linear actuators 312 are coupled with the tension sensing unit 31, respectively. The suspension unit 31 is provided with a receiving member 32. In another embodiment, when the user 8 stands in the receiving member 32, the tension sensing unit 311 of the suspension unit 31 will sense a Z-axis downward weight. After the tension sensing unit 311 senses the weight of the user 8, the weight support linear actuators 312 apply an upward force about 30-40% of the weight to the Z-axis, retaining about 60-70% of the weight to the user 8 for rehabilitation. The receiving member 32 is provided with a board 321. The board 321 has a light reflection portion. The bottom of the weight support system 3 is further provided with at least one moving device 33.

An indoor and outdoor navigation auxiliary device 5 is coupled with the processing unit 141. The indoor and outdoor navigation auxiliary device 5 is further coupled with a navigation and positioning system 51 and a moving unit 56. In an embodiment, the moving unit 56 is coupled with a drive member 561. The navigation and positioning system 51 and the moving unit 56 are coupled with the processing unit 141, respectively. The navigation and positioning system 51 is provided with a virtual map 511 corresponding to a real operation environment (not shown in the drawings) and orients the exoskeleton rehabilitation device 1 at a position point 511*a* in the virtual map 511. By setting a location point 511*b* through the navigation and positioning system 51, the processing unit 141 controls the moving unit 56 to move from the position point 511*a* to the location point 511*b* displayed in the virtual map 511 of the navigation and positioning system 51. The processing unit 141 is further coupled with a video camera 52 and a laser rangefinder 53. Through the video camera 52 and the laser rangefinder 53, the processing unit 141 analyzes the motion trajectory of an object to detect the location of an obstacle in front and controls the moving unit 56 to dodge the obstacle during movement. The indoor and outdoor navigation auxiliary device 5 is further coupled with an ultrasonic sensing unit 54. The ultrasonic sensing unit 54 detects a distance value to the processing unit 141. In an embodiment, the ultrasonic sensing unit 54 detects the distance value between the user 8 wearing the exoskeleton rehabilitation device 1 and the indoor and outdoor navigation auxiliary device 5 for controlling the speed of movement of the indoor and outdoor navigation auxiliary device 5. The indoor and outdoor navigation auxiliary device 5 is further coupled with a front searchlight 55. The indoor and outdoor navigation auxiliary device 5 is further provided with an armrest device 57. The armrest device 57 is provided with at least one pressure sensor 571. The pressure sensor 571 is coupled with the processing unit 141.

A filter 541 is coupled with the ultrasonic sensing unit 54. The filter 541 is used to filter noise of the distance value detected by the ultrasonic sensing unit 54.

A remote monitoring system 6 is coupled with the indoor and outdoor navigation auxiliary device 5. The remote monitoring system 6 is used to monitor the position of the indoor and outdoor navigation auxiliary device 5. The remote monitoring system 6 receives the signals of the angular displacement of the hip joint member 11 and the knee joint member 16 in a walk cycle captured by the first non-contact angle sensor 15*a* and the second non-contact angle sensor 15*b*.

A display unit 7 is coupled with the indoor and outdoor navigation auxiliary device 5. The display unit 7 is used to display the virtual map 511, the position point 511*a*, and the location point 511*b*. The navigation and positioning system 51 can plan the route from the position point 511*a* to the location point 511*b* in the virtual map 511 to display the route on the display unit 7.

Figure 2:
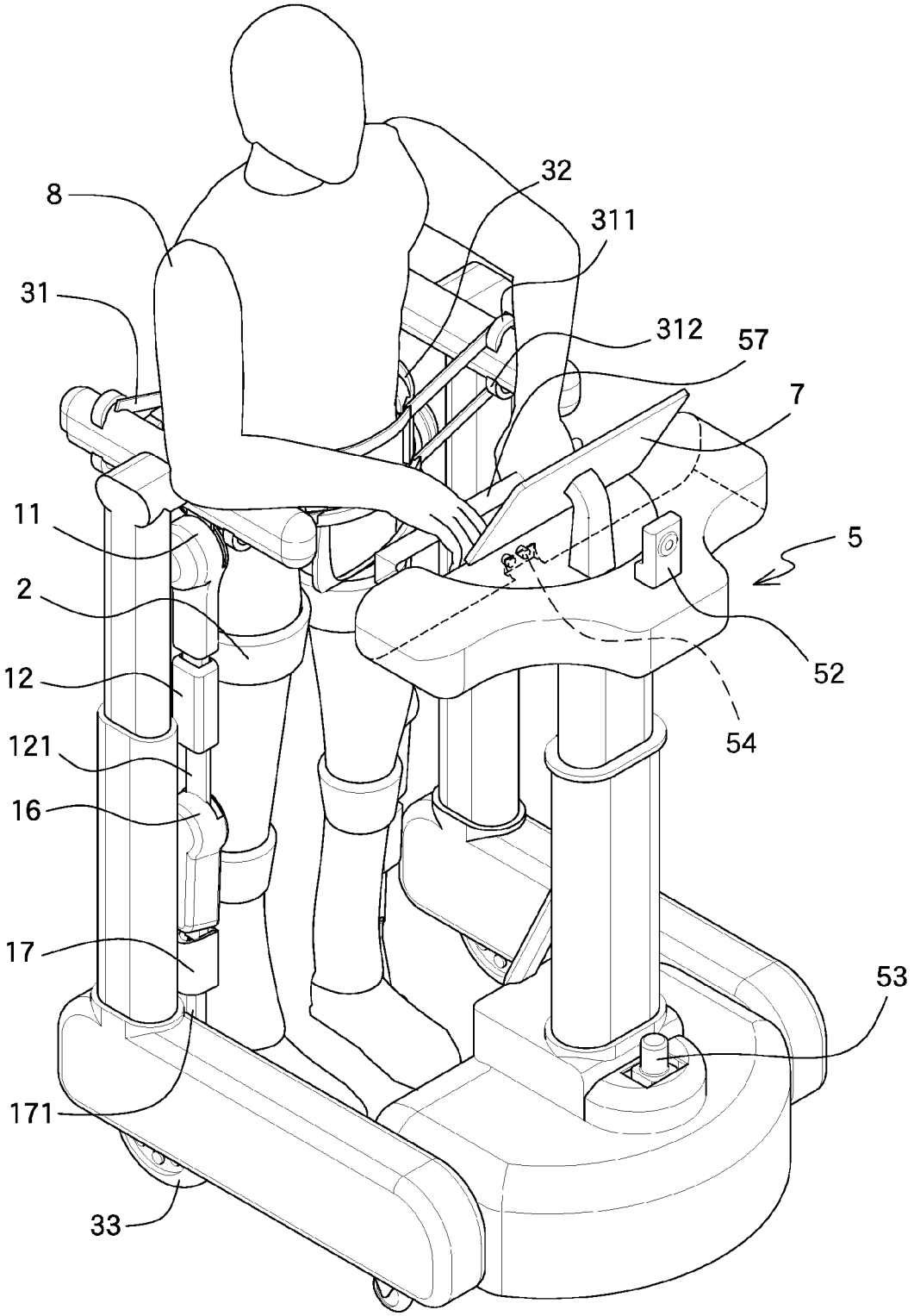
FIG. 2 is a schematic view of the present invention when in use.

Thereby, please refer to FIG. 1 and FIG. 2, after the user 8 stands in the receiving member 32, the suspension unit 31 is displaced in the direction of X-axis through the weight support linear actuators 312. Each weight support linear actuator 312 is able to bear 120 kilograms. Therefore, the weight support linear actuators 312 do a displacement in the direction of X-axis for other screws. This is relative safe. The displacement depends on the height and weight of the user. For example, if the height of the user 8 is 180 centimeters and the weight is 85 kilograms, the tension sensing unit 311 is used to sense the user's weight. According to the theory of rehabilitation medicine, during the rehabilitation training process, providing a constant weight support force is one of the most effective ways of rehabilitation for the user. The international standard of the weight support is about 30-40% of the user's weight. Therefore, during the rehabilitation training process, the weight support of the user 8 will not more than 40% of the user's weight, namely, not all the user's weight is supported totally. Through the present invention, the user applies a part of his/her force for rehabilitation. In an embodiment, when the weight of the user is 85 kilograms, the tension sensing unit 311 will display a value of 25.5-34 kilograms, but not limited thereto. The tension parameter of the tension sensing unit 311 can be adjusted according to the demand of the user's lower limbs. The present invention can be used for the lower limb rehabilitation for users of different weights. The weight support system 3 is provided with the moving device 33 for walking rehabilitation. During walking rehabilitation, the up and down movement of the center of gravity of the human body can be tracked to provide a constant weight support for the user. This provides a movable active weight support function to achieve a better training effect for rehabilitation. Lower limb joints bear more pressure when standing than sitting. The elderly and the person with weak lower limbs easily fall down on the ground due to lack of leg strength when there is a change of his/her body or a change of the ambient environment. The weight support system 3 helps the user 8 reduce a partial weight to mitigate the lower limb load while walking, and maintains a correct upright posture, and provides a certain support force to ensure the safety of the user 8, eliminating the user's tension and fear because of concerning about falling so as to maintain normal walking for a long distance. Besides, the receiving member 32 is adjustable according to the waistline of the user. Through the receiving member 32 to support the weight of the user's lower limbs, it is convenient for use. In addition, the receiving member 32 is provided with the board 321. The board 321 has a light reflection portion. Therefore, the present invention enhances the safety for the user to walk at night.

Figure 3:
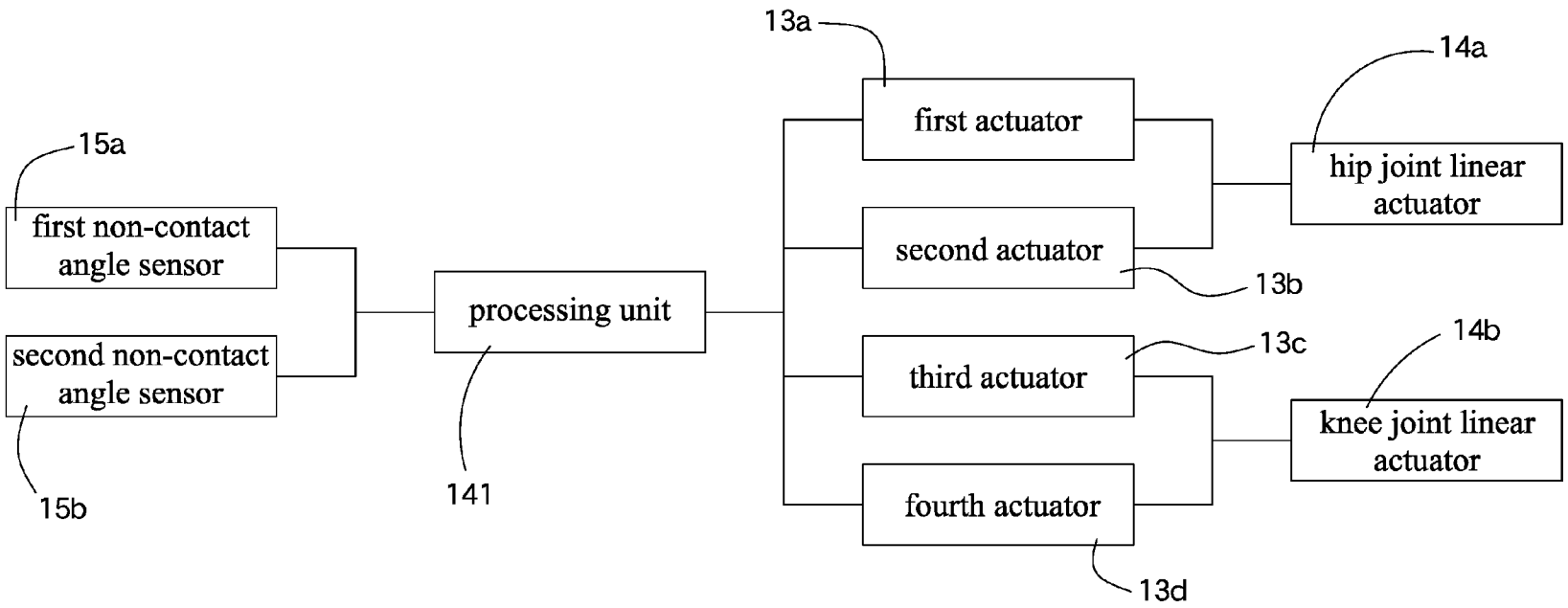
FIG. 3 is a block diagram of pivotal configuration of the hip joint member and the knee joint member of the present invention.

Referring to FIG. 3, the user 8 walks in a normal gait for rehabilitation through the exoskeleton rehabilitation device 1, according to a normal gait trajectory set by the system and corresponding to the gait parameters. For example, step and pace parameters are outputted to control and command each joint through the processing unit 141 for guiding the user 8 to exercise walking for rehabilitation. Thus, the exoskeleton rehabilitation device 1 is used in an active training mode which is a control method of master-slave tracing. Wherein, with regard to a large motion of the hip joint member 11 and the knee joint member 16, it is achieved through the hip joint linear actuator 14*a* and the knee joint linear actuator 14*b*. With regard to a small motion, such as retraction and extension of the hip joint member 11, it is achieved through the first actuator 13*a*, the second actuator 13*b*, the third actuator 13*c*, and the fourth actuator 13*d*. Through the hip joint linear actuator 14*a*, the knee joint linear actuator 14*b*, the first actuator 13*a*, the second actuator 13*b*, the third actuator 13*c*, and the fourth actuator 13*d* to drive the one-legged the exoskeleton rehabilitation device 1, the exoskeleton rehabilitation device 1 is safe, comfortable, reliable, practical and convenient for use. Because the required drive components are fewer, the structure of the present invention is simple and beneficial for assembly. Moreover, the exoskeleton rehabilitation device 1 can be used to train walking in a correct gait repeatedly for the user 8, without using a treadmill, so that the user can directly walk on the even ground like the gait trajectory of a human body walking on the ground. Thereby, the present invention accomplishes exercise training of each joint, active and passive self-adjustment of the muscles in the legs and rehabilitation training of neurologic function. Furthermore, the first non-contact angle sensor 15*a* and the second non-contact angle sensor 15*b* capture the signals of the conditions of each joint and both legs of the user in a walk cycle and send the respective signals to the remote monitoring system 6 through the processing unit 141. The remote monitoring system 6 monitors the harmony of the exoskeleton rehabilitation device 1 driven by the first actuator 13*a*, the second actuator 13*b*, the third actuator 13*c*, and the fourth actuator 13*d* and the motion conditions of the user. Besides, the lengths of the tight length adjustment mechanism 121 and the shank length adjustment mechanism 171 are adjustable according to the demand of the user, such that the user 8 gets the best rehabilitation training to enhance the quality of rehabilitation for the injured leg of the user 8.

Referring to FIG. 1 and FIG. 2, when in use, the user 8 can hold on the armrest device 57. Compared to the conventional pressure sensor, the pressure sensor 571 of the present invention can get the walking information relating to the pressure and pressure distribution. When the user 8 applies a force to the pressure sensor 571, the walking information relating to the pressure and pressure distribution is transmitted to the processing unit 141. The processing unit 141 analyzes the walking information and then commands the moving unit 56 to make a turn. For example, when the user 8 applies a force to the right pressure sensor 571, the pressure value detected by the pressure sensor 571 is transmitted to the processing unit 141. The processing unit 141 determines that the pressure value of the right armrest device 57 greater than that of the left armrest device 57, and then commands the moving unit 56 to turn right, achieving a rotation function for the present invention so as to control the movement of the indoor and outdoor navigation auxiliary device 5. The height of the armrest device 57 is adjustable according to the demand of the user.

Figure 4:
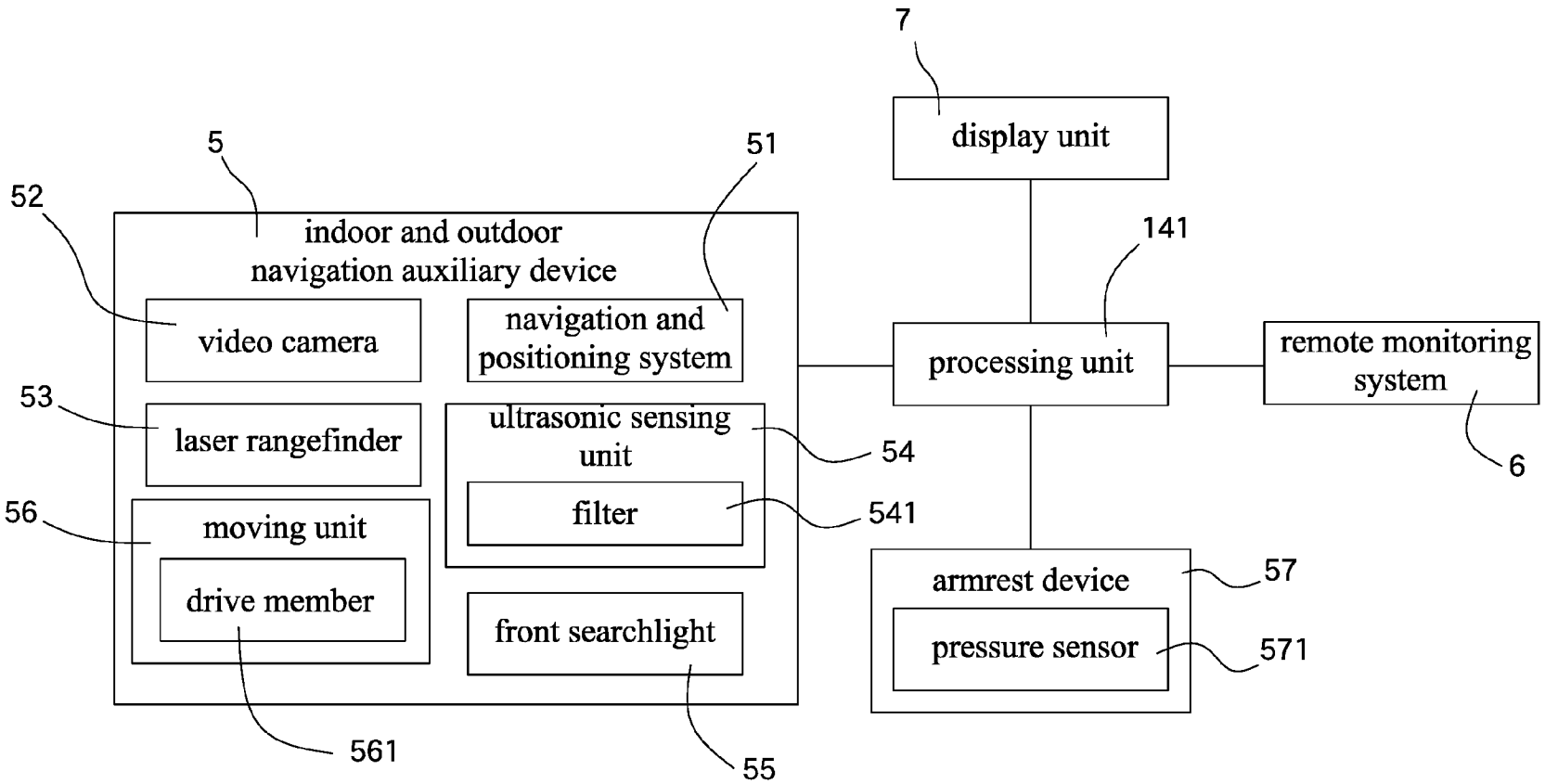
FIG. 4 is a block diagram of the present invention for navigation and walking.
Figure 5:
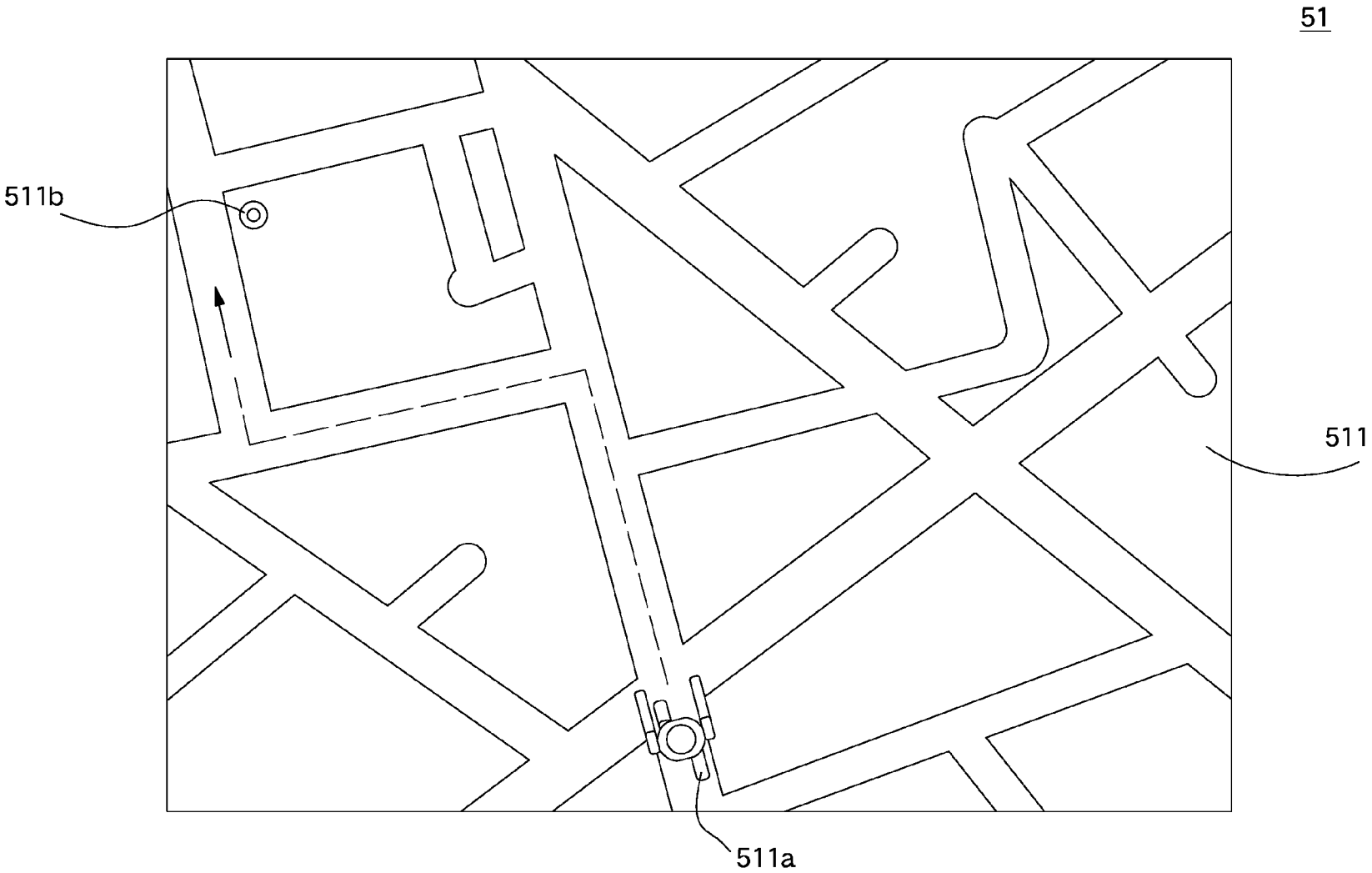
FIG. 5 is a schematic view showing the route planned by the navigation and positioning system and displayed on the display unit of the present invention.

Referring to FIG. 4 and FIG. 5, through the menu of the display unit 7, the user 8 uses the navigation and positioning system 51 to orient the exoskeleton rehabilitation device 1 at the position point 511*a* of the virtual map 511 corresponding to the real operation environment. By setting the location point 511*b*, the navigation and positioning system 51 plans the route from the position point 511*a* to the location point 511*b* in the virtual map 511 through the processing unit 141. The moving unit 56 brings the user 8 wearing the exoskeleton rehabilitation device 1 to move. The display unit 7 displays the virtual map 511, the position point 511*a*, and the location point 511*b*. The present invention helps the user move expansively, not limited to the rehabilitation room. Furthermore, at night, the user 8 can turn on the front searchlight 55 for viewing the front condition. For example, after the user 8 selects the location point 511*b*, the indoor and outdoor navigation auxiliary device 5 starts the navigation function after getting the goal. The display unit 7 displays the planned route for the user to walk to the location point 511*b* smoothly. By providing the remote monitoring system 6, the information of the speed, the coordinates, and the position in the map during walking is transmitted to the remote monitoring system 6 through a wireless communication system (such as GPRS) to monitor the position of the user 8 remotely.

Referring to FIG. 5, the display unit 7 and the remote monitoring system 6 are amended along with movement of the indoor and outdoor navigation auxiliary device 5. For example: replacing a map, amending map parameters and amending the coordinates to cooperate with the new map, enabling the indoor and outdoor navigation auxiliary device 5 to move to anew place, so that the user 8 can clearly understand the orientation of the new place.

Referring to FIG. 5, the indoor and outdoor navigation auxiliary device 5 can be used as a blind guiding device. Through the video camera 52 and the laser rangefinder 53 or an infrared sensor (not shown in the drawings) of the indoor and outdoor navigation auxiliary device 5 to capture the sequence of consecutive images of the area of the front environment, the processing unit 141 analyzes the motion trajectory of the object to detect the position of the front obstacle. During movement, the moving unit 56 guides the exoskeleton rehabilitation device 1 to dodge the front obstacle. Besides, the ultrasonic sensing unit 54 mounted at the back of the indoor and outdoor navigation auxiliary device 5 is used to detect the distance value between the user 8 wearing the exoskeleton rehabilitation device 1 and the indoor and outdoor navigation auxiliary device 5. Through the distance value detected by the ultrasonic sensing unit 54, the processing unit 141 controls the speed of movement of the indoor and outdoor navigation auxiliary device 5 to get the distance between the user 8 and the indoor and outdoor navigation auxiliary device 5. The area of the front environment and the distance between the user 8 and the indoor and outdoor navigation auxiliary device 5 are outputted to the indoor and outdoor navigation auxiliary device 5 through the processing unit 141 to control the speed of movement. For example, when the user 8 walks slowly, the speed of movement of the indoor and outdoor navigation auxiliary device 5 is decelerated to match the user's steps; when the user 8 walks fast, the speed of movement of the indoor and outdoor navigation auxiliary device 5 is accelerated to match the user's steps. When the front space is narrow, although the user 8 is closer to the indoor and outdoor navigation auxiliary device 5, it is unable to accelerate or advance at a high speed. Thus, when the user encounters an obstacle in front, the speed is adjusted and the indoor and outdoor navigation auxiliary device 5 is turned away from the obstacle in front to avoid accidents of collision. The speed of movement of the indoor and outdoor navigation auxiliary device 5 is adjusted according to the width of the front space and the distance between the user 8 and the indoor and outdoor navigation auxiliary device 5 to match the demand of the user 8 for walking and safety.

The present invention has the following advantages and effects:

1. Through the suspension unit 31 to support the user's weight, the tolerance of the user's leg is reduced to mitigate the burden of the lower limbs to support the weight. For users of different weights, the exoskeleton rehabilitation device can be used for a walking rehabilitation training of the lower limbs to achieve the best training effect and to mitigate the burden of the lower limbs to support the weight.

2. Compared to a conventional ambulation rehabilitation training system, the exoskeleton rehabilitation device 1 of the present invention has the hip joint linear actuator 14*a*, the knee joint linear actuator 14*b*, the first actuator 13*a*, the second actuator 13*b*, the third actuator 13*c*, and the fourth actuator 13*d* to drive the one-legged the exoskeleton rehabilitation device 1. The exoskeleton rehabilitation device is safe, comfortable, reliable, practical and convenient. The required drive components are fewer, so the structure of the present invention is simple. Moreover, the exoskeleton rehabilitation device 1 can be used to train walking in a correct gait repeatedly for the user 8, without using a treadmill, so that the user can directly walk on the even ground like the gait trajectory of a human body walking on the ground. Thereby, the present invention accomplishes exercise training of each joint, active and passive self-adjustment of the muscles in the legs and rehabilitation training of neurologic function. Furthermore, the first non-contact angle sensor 15*a* and the second non-contact angle sensor 15*b* capture the signals of the conditions of each joint and both legs of the user in a walk cycle and send the respective signals to the processing unit 141 for controlling the harmony of the exoskeleton rehabilitation device 1 and the user 8, such that the user 8 gets the best rehabilitation training to enhance the quality of rehabilitation for the injured leg of the user 8.

3. The indoor and outdoor navigation auxiliary device 5 of the present invention can be used as a blind guiding device. Through the menu of the display unit 7, the navigation and positioning system 51 orients the exoskeleton rehabilitation device 1 at the position point 511*a* in the virtual map 511 corresponding to the real operation environment and the desired location point 511*b*, and the navigation and positioning system 51 plans the route from the position point 511*a* to the location point 511*b* in the virtual map 511 through the processing unit 141 for the user 8 to clearly understand his/her orientation. The indoor and outdoor navigation auxiliary device 5 uses the ultrasonic sensing unit 54, the video camera 52, the laser rangefinder 53, and the infrared sensor to calculate the advance speed and the turning speed and to dodge the obstacle in front. Furthermore, the indoor and outdoor navigation auxiliary device 5 transmits the information of the speed, the coordinates, and the position in the map during walking to the remote monitoring system 6 through a wireless area network so as to monitor the position of the user 8 remotely. The receiving member is provided with the board having a light reflection portion, which enhances the safety for the user 8 to walk at night. Furthermore, the user 8 can turn on the front searchlight 55 for viewing the front condition.

4. When in use, the user 8 can hold on the armrest device. Compared to the conventional pressure sensor, the pressure sensor of the present invention can get the walking information relating to the pressure and pressure distribution. When the user applies a force to the pressure sensor, the walking information relating to the pressure and pressure distribution is transmitted to the processing unit. The processing unit analyzes the walking information and then commands the moving unit to make a turn.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A multi-function lower limb ambulation rehabilitation and walking assist device, comprising an exoskeleton rehabilitation device, the exoskeleton rehabilitation device comprising a hip joint member, the hip joint member being pivotally connected with a thigh frame, the hip joint member being pivotally connected with a first actuator, the thigh frame being pivotally connected with a second actuator, the first actuator and the second actuator being coupled with a hip joint linear actuator, the first actuator and the second actuator being coupled with a processing unit, one end of the thigh frame, opposite the hip joint member, being provided with a knee joint member, the knee joint member being configured to connect the thigh frame and a shank frame, the knee joint member being pivotally connected with a third actuator, the shank frame being pivotally connected with a fourth actuator, the third actuator and the fourth actuator being coupled with a knee joint linear actuator, the third actuator and the fourth actuator being coupled with the processing unit, the processing unit commanding the first actuator and the second actuator to drive the hip joint linear actuator respectively and the third actuator and the fourth actuator to drive the knee joint linear actuator respectively; the hip joint member and the thigh frame being pivotally connected with each other through a first non-contact angle sensor to sense an angle between the thigh frame and the ground, the knee joint member and the shank frame being pivotally connected with each other through a second non-contact angle sensor to sense an angle between the shank frame and the ground, the first non-contact angle sensor and the second non-contact angle sensor being coupled with the processing unit respectively; the first non-contact angle sensor and the second non-contact angle sensor capturing signals of angular displacement of the hip joint member and the knee joint member in a walk cycle and sending the respective signals to the processing unit, enabling the processing unit to control actuation of the first actuator, the second actuator, the third actuator, and the fourth actuator; the exoskeleton rehabilitation device being connected with a weight support system, the weight support system comprising at least one suspension unit, the suspension unit comprising at least one tension sensing unit to sense a weight, the weight support system being provided with four weight support linear actuators, the weight support linear actuators being coupled with the tension sensing unit respectively to steady the center of gravity of the weight support system and the weight; the suspension unit being provided with a receiving member, the receiving member being provided with a board, the board having a light reflection portion, a bottom of the weight support system being further provided with at least one moving device.

2. The multi-function lower limb ambulation rehabilitation and walking assist device as claimed in claim 1, wherein the exoskeleton rehabilitation device is provided with at least one adjustment member, the adjustment member is adapted to tie the leg of a user, the tightness of the adjustment member is adjustable, the thigh frame is provided with a thigh length adjustment mechanism, and the shank frame is provided with a shank length adjustment mechanism.

3. The multi-function lower limb ambulation rehabilitation and walking assist device as claimed in claim 1, wherein the processing unit is coupled with an indoor and outdoor navigation auxiliary device, the indoor and outdoor navigation auxiliary device is provided with an armrest device, the armrest device is provided with at least one pressure sensor, the pressure sensor is coupled with the processing unit, the indoor and outdoor navigation auxiliary device is further coupled with a navigation and positioning system and a moving unit, the navigation and positioning system and the moving unit are coupled with the processing unit respectively, the navigation and positioning system is provided with a virtual map corresponding to a real operation environment and orients the exoskeleton rehabilitation device at a position point in the virtual map, by setting a location point through the navigation and positioning system, the processing unit controls the moving unit to move from the position point to the location point displayed in the virtual map of the navigation and positioning system, and the indoor and outdoor navigation auxiliary device is further coupled with a front searchlight.

4. The multi-function lower limb ambulation rehabilitation and walking assist device as claimed in claim 3, wherein the indoor and outdoor navigation auxiliary device is coupled with a remote monitoring system, the remote monitoring system is used to monitor the position of the indoor and outdoor navigation auxiliary device, and the remote monitoring system receives the signals of the angular displacement of the hip joint member and the knee joint member in a walk cycle captured by the first non-contact angle sensor and the second non-contact angle sensor.

5. The multi-function lower limb ambulation rehabilitation and walking assist device as claimed in claim 3, wherein the processing unit is further coupled with a video camera and a laser rangefinder, through the video camera and the laser rangefinder, the processing unit analyzes a motion trajectory of an object to detect a relative location of an obstacle in front and controls the moving unit to move for guiding the exoskeleton rehabilitation device to move away from the obstacle.

6. The multi-function lower limb ambulation rehabilitation and walking assist device as claimed in claim 3, wherein the indoor and outdoor navigation auxiliary device is further coupled with a display unit, the display unit is used to display the virtual map, the position point, and the location point, and the navigation and positioning system is able to plan a route from the position point to the location point in the virtual map and display the route on the display unit.

7. The multi-function lower limb ambulation rehabilitation and walking assist device as claimed in claim 3, wherein the indoor and outdoor navigation auxiliary device is further coupled with an ultrasonic sensing unit, and the ultrasonic sensing unit detects a distance value between the exoskeleton rehabilitation device and the indoor and outdoor navigation auxiliary device for the processing unit to control the speed of movement of the moving unit of the indoor and outdoor navigation auxiliary device.

8. The multi-function lower limb ambulation rehabilitation and walking assist device as claimed in claim 7, wherein the ultrasonic sensing unit is coupled with a filter, and the filter is used to filter noise of the distance value detected by the ultrasonic sensing unit.

* * * * *